US009893471B1

(12) United States Patent
Chen

(10) Patent No.: US 9,893,471 B1
(45) Date of Patent: Feb. 13, 2018

(54) HIGH SPEED CONNECTOR ASSEMBLY, RECEPTACLE CONNECTOR AND PLUG CONNECTOR

(71) Applicant: OUPIIN ELECTRONIC (KUNSHAN) CO., LTD, Kunshan (CN)

(72) Inventor: Hsin Chih Chen, Kunshan (CN)

(73) Assignee: OUPIIN ELECTRONIC (KUNSHAN) CO., LTD, Kunshan (CN)

( * ) Notice: Subject to any disclaimer, the term of this patent is extended or adjusted under 35 U.S.C. 154(b) by 0 days.

(21) Appl. No.: 15/453,922

(22) Filed: Mar. 9, 2017

(30) Foreign Application Priority Data

Aug. 3, 2016 (CN) ..... 2016 1 0627021

(51) Int. Cl.
*H01R 13/648* (2006.01)
*H01R 13/6585* (2011.01)
*H01R 13/502* (2006.01)
*H01R 12/72* (2011.01)

(52) U.S. Cl.
CPC ..... *H01R 13/6585* (2013.01); *H01R 12/724* (2013.01); *H01R 13/502* (2013.01)

(58) Field of Classification Search
CPC .. H01R 13/514; H01R 13/113; H01R 13/648; H01R 13/658; H01R 13/6581; H01R 13/6585; H01R 13/6586; H01R 23/688
USPC ..... 439/607.05, 607.01, 607.1
See application file for complete search history.

(56) References Cited

U.S. PATENT DOCUMENTS 6,224,432 B1 * 5/2001 Billman ..... H01R 13/112 439/856
6,227,882 B1 * 5/2001 Ortega ..... H01R 23/688 439/101
6,379,188 B1 * 4/2002 Cohen ..... H01R 13/514 439/101
7,331,830 B2 * 2/2008 Minich ..... H01R 23/688 439/857
7,731,537 B2 * 6/2010 Amleshi ..... H01R 13/514 439/607.05
8,408,939 B2 * 4/2013 Davis ..... H01R 12/724 439/607.01
9,787,029 B1 * 10/2017 Chen ..... H01R 13/6461
9,825,392 B1 * 11/2017 Chen ..... H01R 13/112
9,843,119 B1 * 12/2017 Chen ..... H01R 13/112

* cited by examiner

*Primary Examiner* — Hae Moon Hyeon
(74) *Attorney, Agent, or Firm* — Mark M. Friedman

(57) ABSTRACT

A high speed connector assembly is disclosed in this invention, including a receptacle connector and a plug connector. Two first L-shaped contact pieces of each pair of differential signal receptacle terminals are configured to be splayed apart, and two second L-shaped contact pieces of each pair of differential signal plug terminals are configured to be splayed apart too. When the receptacle connector and the plug connector are engaged with each other, a second extending section of the differential signal plug terminal is pressed onto a first side edge of the differential signal receptacle terminal, and a first extending section of the differential signal receptacle terminal is pressed onto a second side edge of the differential signal plug terminal, thereby forming a stable electrical contact therebetween.

10 Claims, 8 Drawing Sheets

HIGH SPEED CONNECTOR ASSEMBLY, RECEPTACLE CONNECTOR AND PLUG CONNECTOR

BACKGROUND OF THE INVENTION

1. Field of the Invention

The present invention relates to a connector technology, and more particularly to a high speed connector assembly, a receptacle connector and a plug connector, which can form a stable electrical connection between a receptacle terminal and a plug terminal.

2. Description of the Prior Art

In the electronics industry, a right-angle high speed connector assembly can provide a connection interface for multiple circuit boards. For example, it can connect two orthogonal circuit boards to shorten the signal transmission channel length of these systems and improve the channel performance of signal integrity.

The high speed connector assembly is one common connector, which is used for large scale communication equipment, a super high performance server, a huge computer, an industrial computer and a high end storage device. This highly flexible high performance connector has become an ideal choice for telecommunications and data network applications.

However, it is a very important issue how to provide greater throughput and ensure more stable and reliable signal transmission by changing the signal transmission path between a receptacle connector and a plug connector under the condition of no redesign to above connection.

BRIEF SUMMARY OF THE INVENTION

A first object of the present invention is to provide a high speed connector assembly having receptacle terminals and plug terminals, each of which disposes an L-shaped contact piece to make the receptacle terminal and the plug terminal form a balanced contact force and further form a stable electrical connection when mating together.

A second object of the present invention is to provide a receptacle connector, in which each pair of differential signal receptacle terminals dispose a pair of L-shaped contact pieces being configured to be splayed apart for being engaged with side edges of corresponding differential signal plug terminals, thereby forming a balanced contact force and further form a stable electrical connection between the receptacle terminal and the plug terminal.

A third object of the present invention is to provide a plug connector, in which each pair of differential signal plug terminals dispose a pair of L-shaped contact pieces being configured to be splayed apart for being engaged with side edges of corresponding differential signal receptacle terminals, thereby forming a balanced contact force and further form a stable electrical connection between the receptacle terminal and the plug terminal.

Other objects and advantages of the present invention may be further understood from the technical features disclosed by the present invention.

To achieve the aforementioned object or other objects of the present invention, the present invention adopts the following technical solution.

The present invention provides a high speed connector assembly, which comprises a receptacle connector and a plug connector. The receptacle connector includes at least an insulating cover and multiple terminal modules mounted in the insulating cover and arranged in parallel. Each terminal module includes an insulating frame and a receptacle terminal group retained in the insulating frame. The receptacle terminal group is located in a first vertical plane and includes multiple pairs of differential signal receptacle terminals and multiple grounding receptacle terminals. Two grounding receptacle terminals are respectively arranged on two sides of each pair of differential signal receptacle terminals. Each pair of differential signal receptacle terminals include two differential signal receptacle terminals, each of which has a main body located in the first vertical plane, a first L-shaped contact piece extending forward from one end of the main body, and a mounting portion extending downward from the other end of the main body. The first L-shaped contact piece has a first tilted arm and a first extending section. The first tilted arm is located in the first vertical plane, extends upward from one end of the main body and tilts toward the grounding receptacle terminal adjacent to the differential signal receptacle terminal. The first extending section is connected to a first side edge of the first tilted arm and is formed by bending perpendicularly to the first vertical plane. The first L-shaped contact pieces of each pair of differential signal receptacle terminals are symmetrical to each other, and are together configured to be splayed apart. The plug connector includes a plug housing and multiple rows of plug terminals mounted in the plug housing. Each row of plug terminals is located in a second vertical plane and includes multiple pairs of differential signal plug terminals and multiple grounding plug terminals. Two grounding plug terminals are respectively disposed on two sides of each pair of differential signal plug terminals. Each pair of differential signal plug terminals include two differential signal plug terminals, each of which has a straight section located in the second vertical plane, a second L-shaped contact piece extending upward from one end of the straight section, and a mounting end extending downward from the other end of the straight section. The second L-shaped contact piece has a second tilted arm and a second extending section. The second tilted arm is located in the second vertical plane, extends upward from one end of the straight section and tilts toward the grounding plug terminal adjacent to the differential signal plug terminal. The second extending section is connected to a second side edge of the second tilted arm and is formed by bending perpendicularly to the second vertical plane. The second L-shaped contact pieces of each pair of differential signal plug terminals are symmetrical to each other, and are together configured to be splayed apart. When the receptacle connector and the plug connector are electrically engaged with each other, the second extending section of the differential signal plug terminal is pressed onto the first side edge of the differential signal receptacle terminal, and the first extending section of the differential signal receptacle terminal is pressed onto the second side edge of the differential signal plug terminal, thereby forming a stable electrical connection.

In one embodiment, the first extending section is located in the front of the first side edge of the first tilted arm, and the first side edge forms a first notch near the first extending section; and the second extending section is located in the front of the second side edge of the second tilted arm, and the second side edge forms a second notch near the second extending section.

In one embodiment, the second vertical plane is parallel to the first vertical plane.

The present invention further provides a receptacle connector, which comprises at least an insulating cover and multiple terminal modules mounted in the insulating cover and arranged in parallel. Each terminal module includes an insulating frame and a receptacle terminal group retained in the insulating frame. The receptacle terminal group is located in a first vertical plane and includes multiple pairs of differential signal receptacle terminals and multiple grounding receptacle terminals. Two grounding receptacle terminals are respectively arranged on two sides of each pair of differential signal receptacle terminals. Each pair of differential signal receptacle terminals include two differential signal receptacle terminals, each of which has a main body located in the first vertical plane, a first L-shaped contact piece extending forward from one end of the main body, and a mounting portion extending downward from the other end of the main body. The first L-shaped contact piece has a first tilted arm and a first extending section. The first tilted arm is located in the first vertical plane, extends upward from one end of the main body and tilts toward the grounding receptacle terminal adjacent to the differential signal receptacle terminal. The first extending section is connected to a first side edge of the first tilted arm and is formed by bending perpendicularly to the first vertical plane. The first L-shaped contact pieces of each pair of differential signal receptacle terminals are symmetrical to each other, and are together configured to be splayed apart.

The present invention further provides a plug connector, which comprises a plug housing and multiple rows of plug terminals mounted in the plug housing. Each row of plug terminals is located in a second vertical plane and includes multiple pairs of differential signal plug terminals and multiple grounding plug terminals. Two grounding plug terminals are respectively disposed on two sides of each pair of differential signal plug terminals. Each pair of differential signal plug terminals includes two differential signal plug terminals, each of which has a straight section located in the second vertical plane, a second L-shaped contact piece extending upward from one end of the straight section, and a mounting end extending downward from the other end of the straight section. The second L-shaped contact piece has a second tilted arm and a second extending section. The second tilted arm is located in the second vertical plane, extends upward from one end of the straight section and tilts toward the grounding plug terminal adjacent to the differential signal plug terminal. The second extending section is connected to a second side edge of the second tilted arm and is formed by bending perpendicularly to the second vertical plane. The second L-shaped contact pieces of each pair of differential signal plug terminals are symmetrical to each other, and are together configured to be splayed apart.

In comparison with the prior art, the high speed connector assembly of the present invention employs the receptacle terminals and the plug terminals, each of which disposes an L-shaped contact piece. The L-shaped contact piece of each receptacle terminal can electrically contact with the side edge of the corresponding plug terminal, and the L-shaped contact piece of each plug terminal also can electrically contact with the side edge of the corresponding receptacle terminal, thereby forming a balanced contact force and further forming a stable electrical connection between the receptacle terminal and the plug terminal when mating together.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "up", "down", "front", "back", "left", "right", "top", "bottom" etc., are only used with reference to the orientation of the accompanying drawings. Therefore, the used directional terms are intended to illustrate, but not to limit, the present invention.

Figure 1:
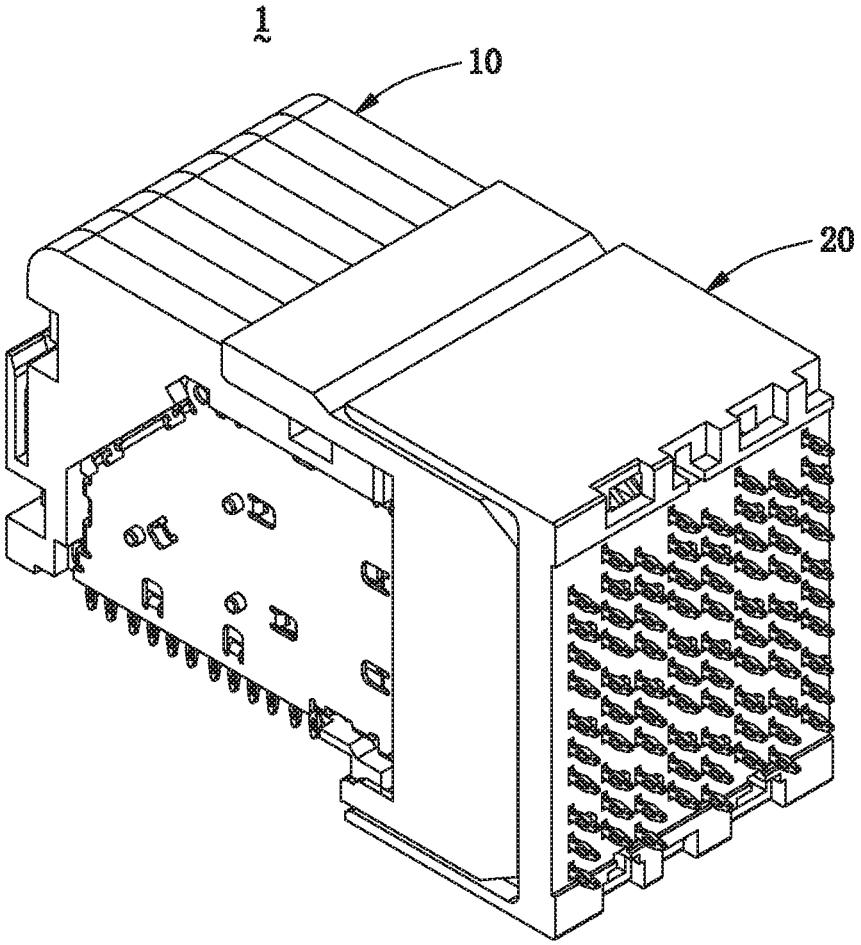
FIG. 1 is a perspective view of a high speed connector assembly of the present invention.
Figure 2:
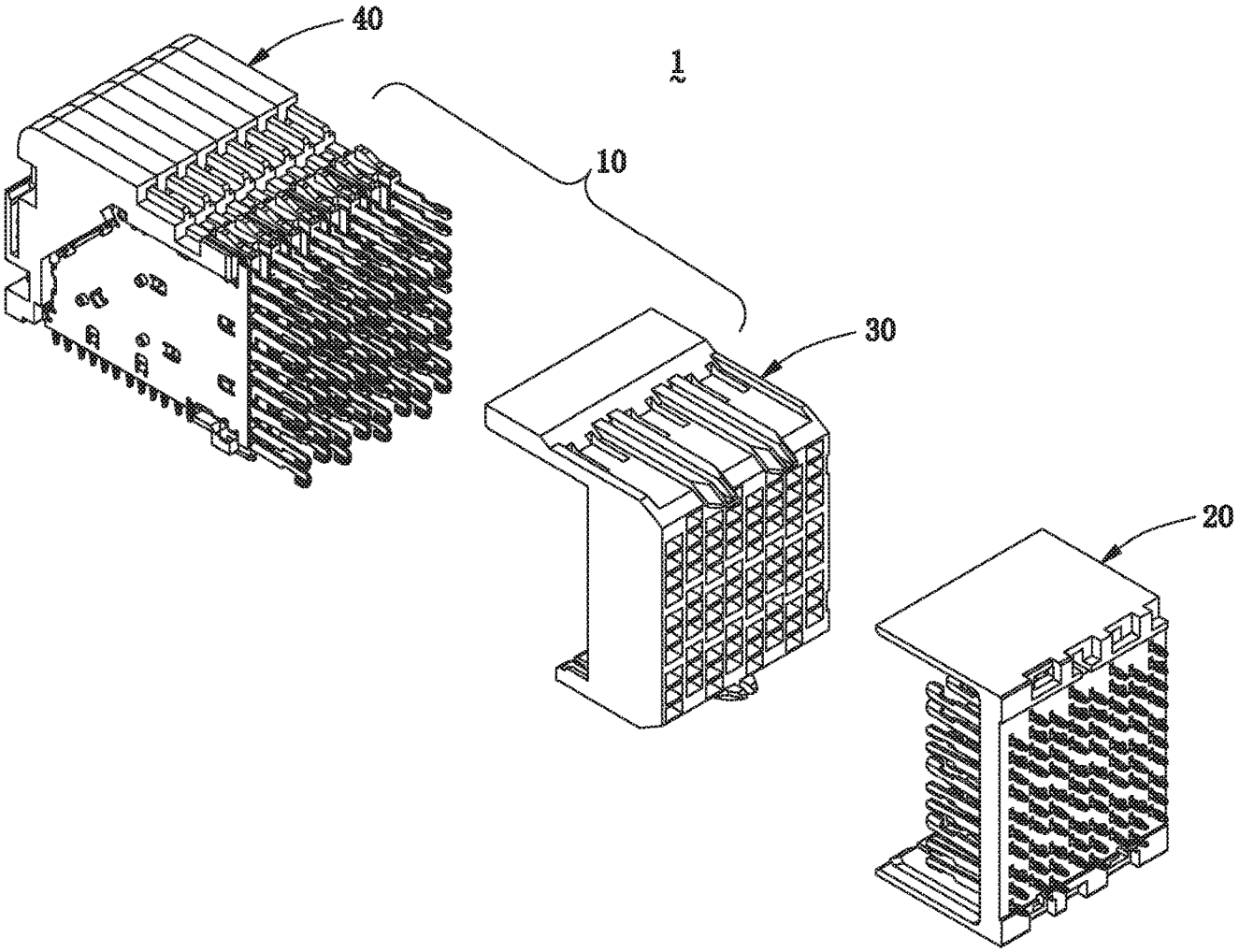
FIG. 2 is a disassembled view of the high speed connector assembly of the present invention.
Figure 3:
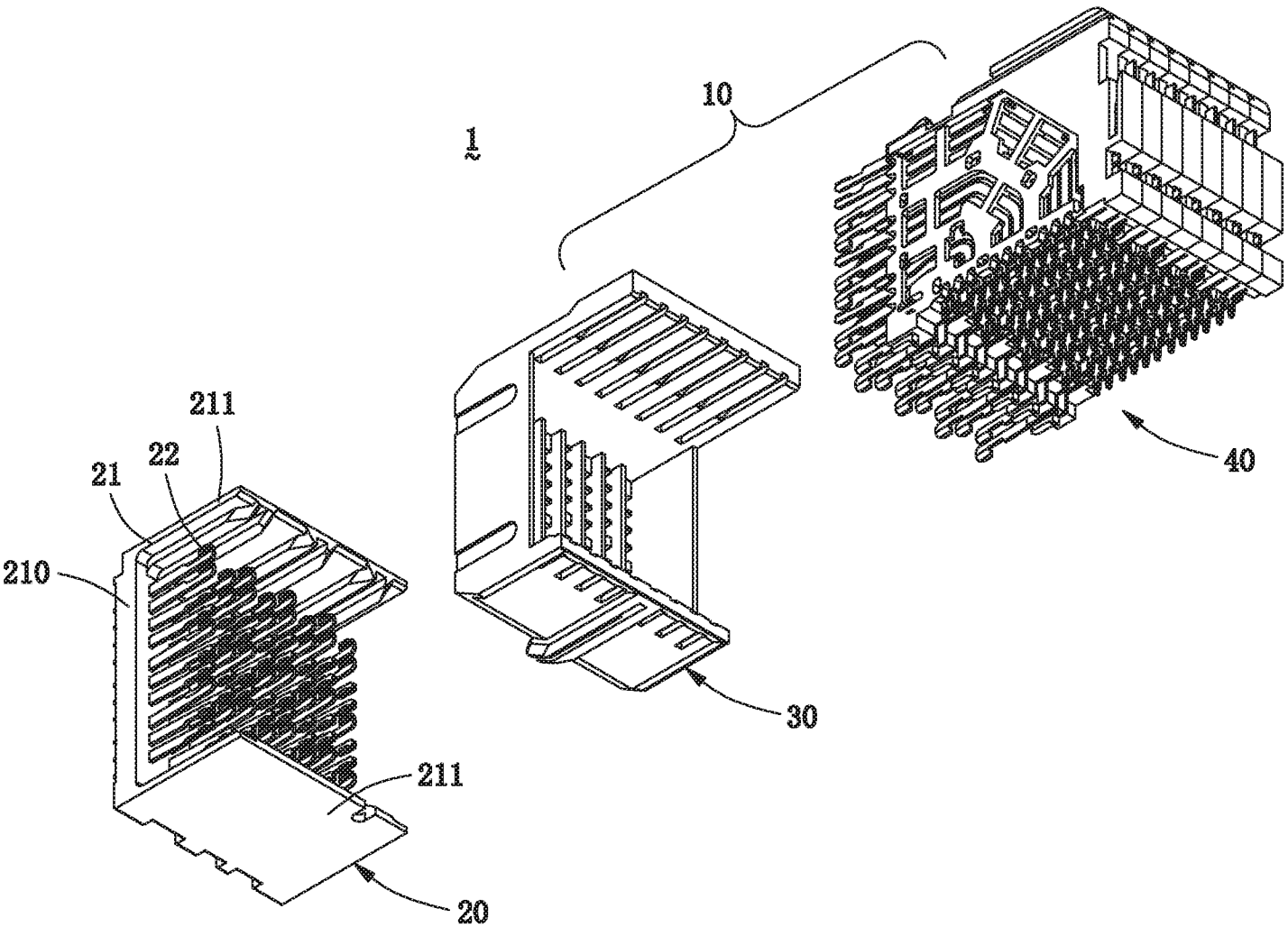
FIG. 3 is a disassembled view of the high speed connector assembly along another direction.

Please refer to FIGS. 1 to 3, a high speed connector assembly 1 of the present invention includes a receptacle connector 10 and a plug connector 20. The receptacle connector 10 may be a right-angle connector, the mating direction of which is parallel to a horizontal circuit board (not shown), on which the receptacle connector 10 is mounted. The plug connector 20 may be a vertical end connector, the mating direction of which is perpendicular to a vertical circuit board (not shown), on which the plug connector 20 is mounted.

Please refer to FIGS. 2 and 3, the receptacle connector 10 includes at least an insulating cover 30 and multiple terminal modules 40 mounted in the insulating cover 30 and arranged in parallel from left to right.

Figure 4:
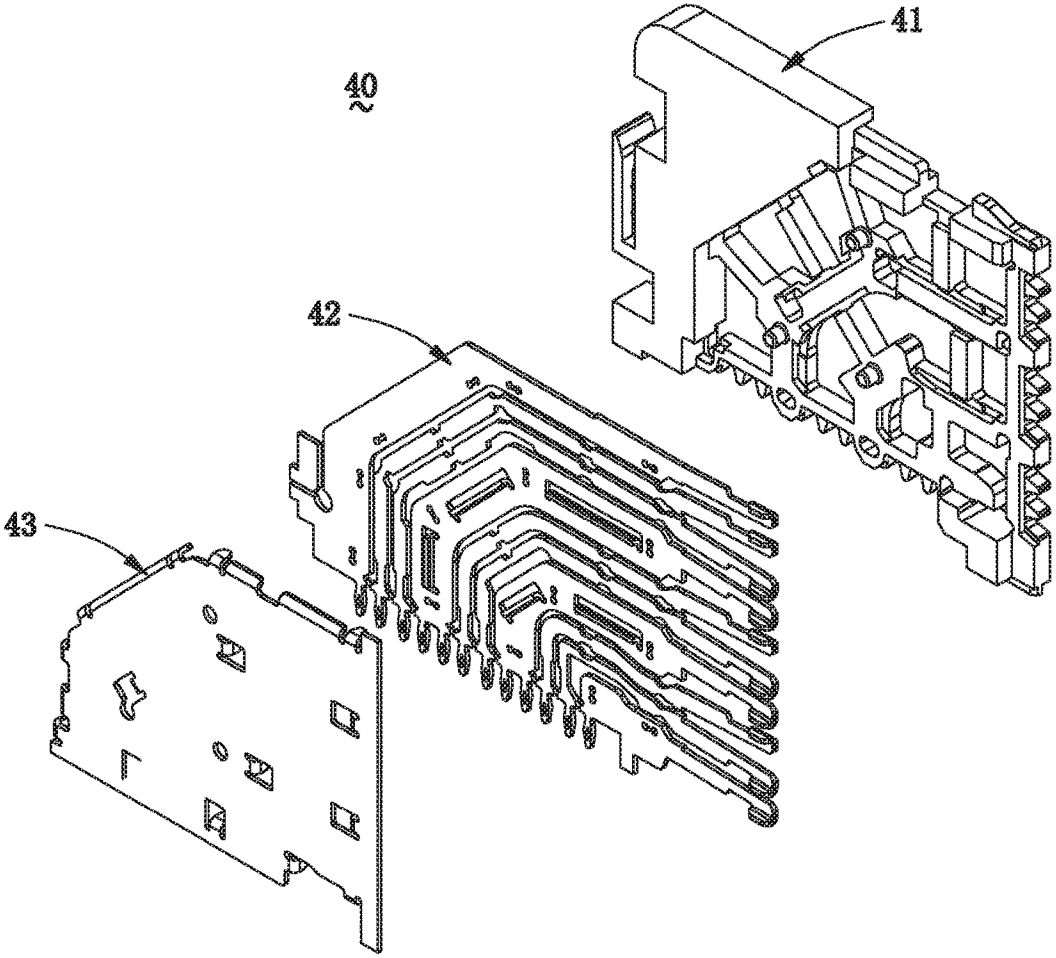
FIG. 4 is a disassembled view of one terminal module of a receptacle connector of the present invention.

Referring to FIG. 4, each terminal module 40 includes at least an insulating frame 41 and a receptacle terminal group 42 retained in the insulating frame 41. In the embodiment, the terminal module 40 further includes a grounding plate 43 mounted on one side of the insulating frame 41. In the embodiment, the receptacle terminal group 42 and the insulating frame 41 are combined together by injection molding.

Figure 5:
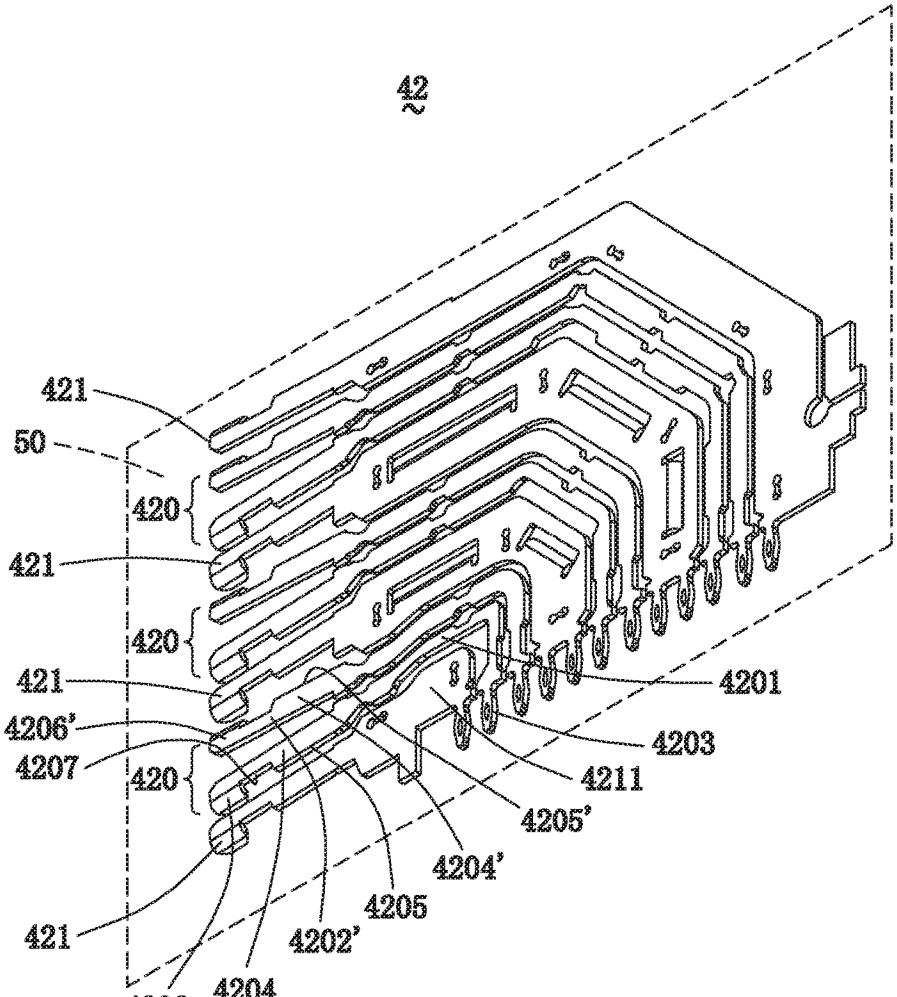
FIG. 5 is a perspective view of one receptacle terminal group of the receptacle connector of the present invention.

Please refer to FIG. 5, the receptacle terminal group 42 includes multiple pairs of differential signal receptacle terminals 420 and multiple grounding receptacle terminals 421. There are two grounding receptacle terminals 421 respectively arranged on two sides of each pair of differential signal receptacle terminals 420. In the embodiment, all of the differential signal receptacle terminals 420 and the grounding receptacle terminals 421 in one receptacle terminal group 42 are located in a first vertical plane 50. Each pair of differential signal receptacle terminals 420 include two differential signal receptacle terminals 420.

Referring to FIG. 5, each differential signal receptacle terminal 420 has a main body 4201 located in the first vertical plane 50, a first L-shaped contact piece 4202 extending forward from one end of the main body 4201, and a mounting portion 4203 extending downward from the other end of the main body 4201.

Referring to FIG. 5, the first L-shaped contact piece 4202 has a first tilted arm 4204 and a first extending section 4206. The first tilted arm 4204 is located in the first vertical plane 50, extends forward from one end of the main body 4201 and tilts toward one adjacent grounding receptacle terminal 421. The first extending section 4206 is connected to a first side edge 4205 of the first tilted arm 4204 and is formed by bending perpendicularly to the first vertical plane 50.

In the embodiment, the first side edge 4205 refers to the side edge of the first tilted arm 4204 adjacent to the adjacent grounding receptacle terminal 421. The first extending section 4206 is located in the front of the first side edge 4205. The first side edge 4205 forms a first notch 4207, which is near the first extending section 4206 or is located in rear of the first extending section 4206.

Referring to FIG. 5, the first L-shaped contact pieces 4202 of each pair of differential signal receptacle terminals 420 are symmetrical in structure. In detail, the first tilted arm 4204 of one differential signal receptacle terminal 420 tilts toward one lower grounding receptacle terminal 421 adjacent to the one differential signal receptacle terminal 420 in the first vertical plane 50, and the first extending section 4206 is formed on a lower side edge (that is, the first side edge 4205) of the first tilted arm 4204. The first tilted arm 4204' of the other differential signal receptacle terminal 420 tilts toward one upper grounding receptacle terminal 421 adjacent to the other differential signal receptacle terminal 420 in the first vertical plane 50, and the first extending section 4206' is formed on an upper side edge (that is, the first side edge 4205') of the first tilted arm 4204'. Therefore, the two first L-shaped contact pieces 4202, 4202' of the pair of differential signal receptacle terminals 420 are together configured to be splayed apart.

In the embodiment, the mounting portion 4203 is located in the first vertical plane 50 and is a needle shaped pin, which can be connected to a signal point of the horizontal circuit board.

As shown in FIG. 5, in the embodiment, the grounding receptacle terminal 421 and the differential signal receptacle terminal 420 have roughly the same structure, and the biggest difference is that the dimensions of their main bodies 4201, 4211 are different. For example, the width of the main body 4211 of the grounding receptacle terminal 421 is larger than that of the main body 4201 of the differential signal receptacle terminal 420. Hence, the structure of the grounding receptacle terminal 421 will no longer be described in detail here.

Referring to FIG. 3, the plug connector 20 includes a plug housing 21 and multiple rows of plug terminals 22 mounted in the plug housing 21. The plug housing 21 has a base 210 and two sidewalls 211 standing on two sides of the base 210. These plug terminals 22 are mounted on the base 210 and can be electrically connected to the corresponding terminal modules 40.

Figure 6:
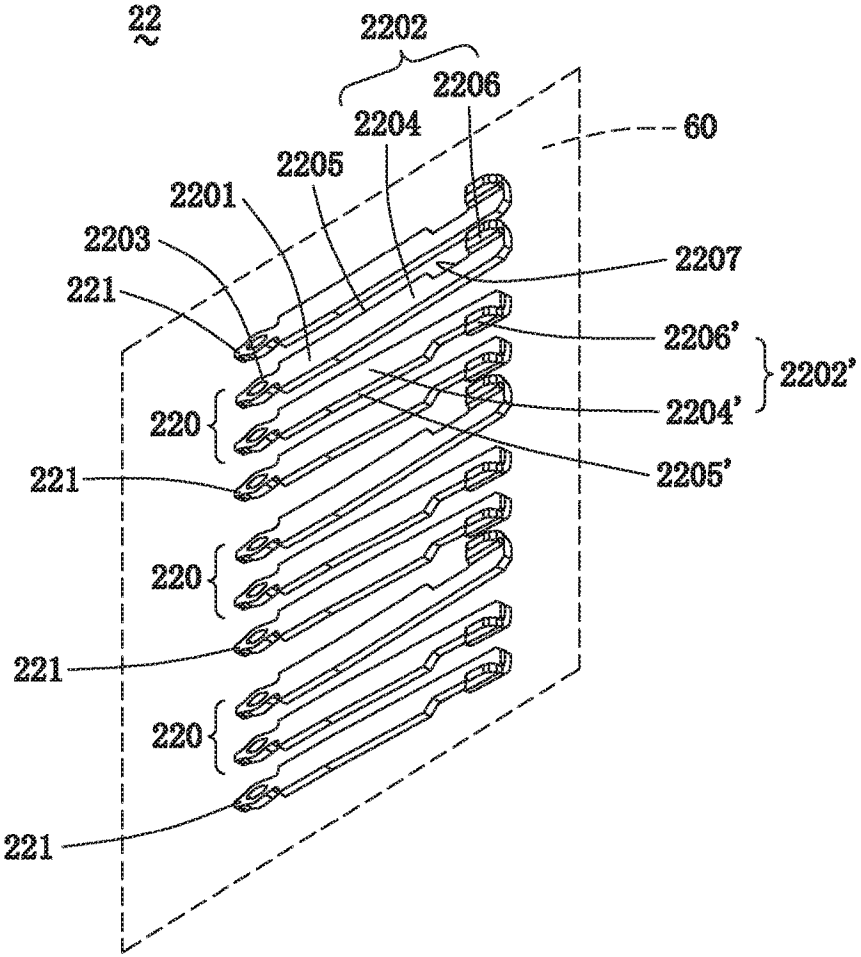
FIG. 6 is a perspective view of one row of plug terminals of a plug connector of the present invention.

Please refer to FIG. 6, each row of plug terminals 22 includes multiple pairs of differential signal plug terminals 220 and multiple grounding plug terminals 221. There are two grounding plug terminals 221 respectively arranged on two sides of each pair of differential signal plug terminals 220. In the embodiment, these differential signal plug terminals 220 and these grounding plug terminals 221, which are arranged in the same row, are located in a second vertical plane 60. Each pair of differential signal plug terminals 220 include two differential signal plug terminals 220. In the embodiment, the grounding plug terminal 221 and the differential signal plug terminal 220 have roughly the same structure.

The following text takes one of the differential signal plug terminals 220 as an example to specifically describe the structure of the plug terminal 22 of the present invention.

Referring to FIG. 6, the differential signal plug terminal 220 has a straight section 2201, a second L-shaped contact piece 2202 extending upward from one end of the straight section 2201, and a mounting end 2203 extending downward from the other end of the straight section 2201. The second L-shaped contact piece 2202 has a second tilted arm 2204 and a second extending section 2206. The second tilted arm 2204 is located in the second vertical plane 60, extends upward from one end of the straight section 2201 and tilts toward one adjacent grounding plug terminal 221. The second extending section 2206 is connected to a second side edge 2205 of the second tilted arm 2204 and is formed by bending perpendicularly to the second vertical plane 60.

In the embodiment, the second side edge 2205 refers to the side edge of the second tilted arm 2204 adjacent to the adjacent grounding plug terminal 221. The second extending section 2206 is located in the front of the second side edge 2205. The second side edge 2205 forms a second notch 2207, which is near the second extending section 2206 or is located in rear of the second extending section 2206.

Referring to FIG. 6, each pair of differential signal plug terminals 220 are symmetrical to each other. In detail, the second extending section 2206 of the second L-shaped contact piece 2202 of one differential signal plug terminal 220 is located on a left side edge (that is, the second side edge 2205) of the second tilted arm 2204, and the second extending section 2206' of the second L-shaped contact piece 2202' of the other differential signal plug terminal 220 is located on a right side edge (that is, the second side edge 2205') of the second tilted arm 2204'. Therefore, the two second L-shaped contact pieces 2202, 2202' of the pair of differential signal plug terminals 220 are together configured to be splayed apart.

In the embodiment, the second vertical plane 60 is parallel to the first vertical plane 50.

In the embodiment, the mounting end 2203 is located in the second vertical plane 60 and is a needle shaped pin, which can be connected to a signal point of the horizontal circuit board.

The following text will introduce the electrical engagement between the receptacle terminal 420 and the plug terminal 220.

Figure 7:
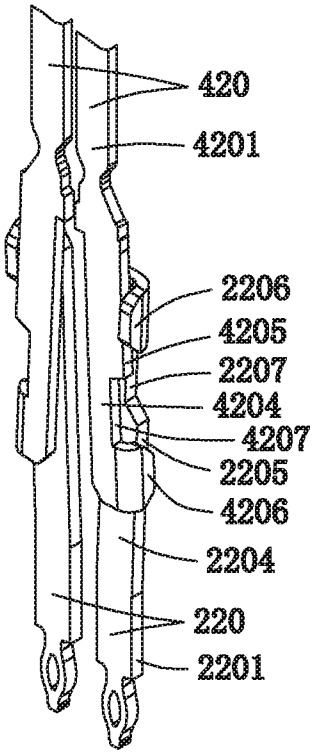
FIG. 7 is a schematic view of one pair of differential signal receptacle terminals and one pair of differential signal plug terminals after mating.
Figure 8:
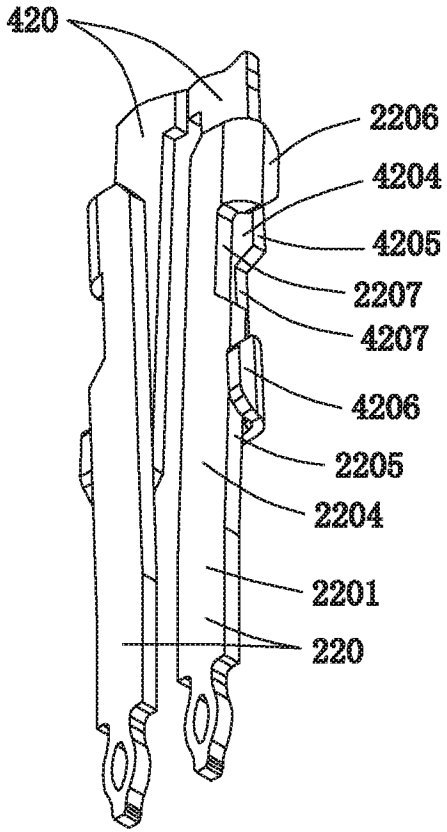
FIG. 8 is a schematic view of the two pairs of terminals along another direction after mating.

Please refer to FIGS. 7 and 8, when the receptacle connector 10 and the plug connector 20 shown in FIG. 1 are electrically engaged with each other, the second extending sections 2206 of each pair of differential signal plug terminals 220 are inserted between the first extending sections 4206 of the corresponding pair of differential signal receptacle terminals 420. Then, each second extending section 2206 slides along the corresponding first extending section 4206, and the second extending section 2206 enters into the corresponding first notch 4207. Next, the second extending section 2206 leaves the corresponding first notch 4207, slides a predetermined distance toward the corresponding main body 4201 along the first side edge 4205 of the first tilted arm 4204, and finally stops on the first side edge 4205. Meanwhile, the first extending section 4206 passes by the corresponding second notch 2207 and slides the predetermined distance toward the corresponding straight section 2201 along the second side edge 2205 of the second tilted arm 2204, and finally stops on the second side edge 2205.

After the differential signal plug terminal 220 and the differential signal receptacle terminal 420 are mated together, the second extending section 2206 of the differential signal plug terminal 220 is pressed onto the first side edge 4205 of the differential signal receptacle terminal 420, and the first extending section 4206 of the differential signal receptacle terminal 420 is pressed onto the second side edge 2205 of the differential signal plug terminal 220. Therefore there forms double contacts, produces a balanced contact force, and forms a stable electrical connection between the receptacle terminal and the plug terminal mated together.

As described above, the high speed connector assembly 1 of the present invention employs the receptacle terminals 420 and the plug terminals 22, each of which disposes an L-shaped contact piece 4202, 2202. The L-shaped contact piece 4202 of each receptacle terminal 420 can electrically contact with the side edge 2205 of the corresponding plug terminal 22, and the L-shaped contact piece 2202 of each plug terminal 22 also can electrically contact with the side edge 4205 of the corresponding receptacle terminal 420, thereby producing a balanced contact force and further forming a stable electrical connection between the receptacle terminal 420 and the plug terminal 22 when mating together.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A high speed connector assembly, which comprises:

a receptacle connector including at least an insulating cover and multiple terminal modules mounted in the insulating cover and arranged in parallel; each terminal module including an insulating frame and a receptacle terminal group retained in the insulating frame; the receptacle terminal group being located in a first vertical plane and including multiple pairs of differential signal receptacle terminals and multiple grounding receptacle terminals; two grounding receptacle terminals being respectively arranged on two sides of each pair of differential signal receptacle terminals; each pair of differential signal receptacle terminals including two differential signal receptacle terminals, each of which has a main body located in the first vertical plane, a first L-shaped contact piece extending forward from one end of the main body, and a mounting portion extending downward from the other end of the main body; wherein the first L-shaped contact piece has a first tilted arm and a first extending section; the first tilted arm being located in the first vertical plane, extending upward from one end of the main body and tilting toward the grounding receptacle terminal adjacent to the differential signal receptacle terminal; the first extending section being connected to a first side edge of the first tilted arm and being formed by bending perpendicularly to the first vertical plane; the first L-shaped contact pieces of each pair of differential signal receptacle terminals being symmetrical to each other, and being together configured to be splayed apart; and a plug connector including a plug housing and multiple rows of plug terminals mounted in the plug housing; each row of plug terminals being located in a second vertical plane and including multiple pairs of differential signal plug terminals and multiple grounding plug terminals; two grounding plug terminals being respectively disposed on two sides of each pair of differential signal plug terminals; each pair of differential signal plug terminals including two differential signal plug terminals, each of which has a straight section located in the second vertical plane, a second L-shaped contact piece extending upward from one end of the straight section, and a mounting end extending downward from the other end of the straight section; wherein the second L-shaped contact piece has a second tilted arm and a second extending section; the second tilted arm being located in the second vertical plane, extending upward from one end of the straight section and tilting toward the grounding plug terminal adjacent to the differential signal plug terminal; the second extending section being connected to a second side edge of the second tilted arm and being formed by bending perpendicularly to the second vertical plane; the second L-shaped contact pieces of each pair of differential signal plug terminals being symmetrical to each other, and being together configured to be splayed apart;

when the receptacle connector and the plug connector are electrically engaged with each other, the second extending section of the differential signal plug terminal being pressed onto the first side edge of the differential signal receptacle terminal, and the first extending section of the differential signal receptacle terminal being pressed onto the second side edge of the differential signal plug terminal, thereby forming a stable electrical connection.

2. The high speed connector assembly as claimed in claim 1, wherein the first extending section is located in the front of the first side edge of the first tilted arm, and the first side edge forms a first notch near the first extending section; and the second extending section is located in the front of the second side edge of the second tilted arm, and the second side edge forms a second notch near the second extending section.

3. The high speed connector assembly as claimed in claim 1, wherein the second vertical plane is parallel to the first vertical plane.

4. A receptacle connector, which comprises:

at least an insulating cover, and multiple terminal modules mounted in the insulating cover and arranged in parallel; each terminal module including an insulating frame and a receptacle terminal group retained in the insulating frame; the receptacle terminal group being located in a first vertical plane and including multiple pairs of differential signal receptacle terminals and multiple grounding receptacle terminals; two grounding receptacle terminals being respectively arranged on two sides of each pair of differential signal receptacle terminals; each pair of differential signal receptacle terminals including two differential signal receptacle terminals, each of which has a main body located in the first vertical plane, a first L-shaped contact piece extending forward from one end of the main body, and a mounting portion extending downward from the other end of the main body;

wherein the first L-shaped contact piece has a first tilted arm and a first extending section; the first tilted arm being located in the first vertical plane, extending upward from one end of the main body and tilting toward the grounding receptacle terminal adjacent to the differential signal receptacle terminal; the first extending section being connected to a first side edge of the first tilted arm and being formed by bending perpendicularly to the first vertical plane; the first L-shaped contact pieces of each pair of differential signal receptacle terminals being symmetrical to each other, and being together configured to be splayed apart.

5. The receptacle connector as claimed in claim 4, wherein the first extending section is located in the front of the first side edge of the first tilted arm, and the first side edge forms a first notch near the first extending section.

6. The receptacle connector as claimed in claim 4, wherein the terminal module further includes a grounding plate mounted on one side of the insulating frame, and the mounting portion is located in the first vertical plane.

7. A plug connector, which comprises:

a plug housing; and multiple rows of plug terminals mounted in the plug housing; each row of plug terminals being located in a second vertical plane and including multiple pairs of differential signal plug terminals and multiple grounding plug terminals; two grounding plug terminals being respectively disposed on two sides of each pair of differential signal plug terminals; each pair of differential signal plug terminals including two differential signal plug terminals, each of which has a straight section located in the second vertical plane, a second L-shaped contact piece extending upward from one end of the straight section, and a mounting end extending downward from the other end of the straight section;

wherein the second L-shaped contact piece has a second tilted arm and a second extending section; the second tilted arm being located in the second vertical plane, extending upward from one end of the straight section and tilting toward the grounding plug terminal adjacent to the differential signal plug terminal; the second extending section being connected to a second side edge of the second tilted arm and being formed by bending perpendicularly to the second vertical plane; the second L-shaped contact pieces of each pair of differential signal plug terminals being symmetrical to each other, and being together configured to be splayed apart.

8. The plug connector as claimed in claim 7, wherein the plug housing has a base and two sidewalls standing on two sides of the base; and these plug terminals are mounted on the base.

9. The plug connector as claimed in claim 7, wherein the second extending section is located in the front of the second side edge of the second tilted arm, and the second side edge forms a second notch near the second extending section.

10. The plug connector as claimed in claim 7, wherein the mounting end is located in the second vertical plane.

* * * * *